US006298590B1

(12) United States Patent
Levinson

(10) Patent No.: US 6,298,590 B1
(45) Date of Patent: Oct. 9, 2001

(54) AUTO WINDOW GRAPHICS HOLDER

(76) Inventor: Samuel Levinson, 1235 Knox Dr., Yardley, PA (US) 19067

( * ) Notice: Subject to any disclaimer, the term of this patent is extended or adjusted under 35 U.S.C. 154(b) by 0 days.

(21) Appl. No.: 09/535,214

(22) Filed: Mar. 27, 2000

(51) Int. Cl.[7] ..... G09F 21/04

(52) U.S. Cl. ..... 40/591; 40/593; 40/643; 40/644; 40/652; 40/658; 24/563; 224/482; 224/277; 211/89.01

(58) Field of Search ..... 40/591, 593, 643, 40/644, 658, 659, 666, 667, 652, 792, 794, 791; 211/120, 89.01; 24/563, 326; 224/482, 277; 248/534, 535

(56) References Cited

U.S. PATENT DOCUMENTS

| | | | | |
|---|---|---|---|---|
| 2,902,241 | * | 9/1959 | Spitko | 40/591 |
| 3,541,714 | * | 11/1970 | Bruck, Jr. | 40/791 |
| 3,981,091 | * | 9/1976 | Wiener, Jr. | 40/791 |
| 4,258,492 | * | 3/1981 | Williams | 40/591 |
| 4,889,268 | * | 12/1989 | Shubeck | 40/591 |
| 4,986,209 | * | 1/1991 | Spica | 116/28 R |
| 5,131,177 | * | 7/1992 | Sy, Jr. | 40/591 |
| 5,463,974 | * | 11/1995 | Seeder | 40/591 |
| 5,538,311 | * | 7/1996 | Fusco et al. | 40/593 |
| 6,258,200 | * | 7/2001 | Kassab | 40/593 |

OTHER PUBLICATIONS

Catalog Copy: Federal Buyers Guide Holder Kits: HG 100. MBR Marketing, P. 7: Warranty Form Holder Kits; Odometer Disclosure statements.

These Materials are Discussed and Disclosed in the specification under the heading: Background: Prior Art.

* cited by examiner

*Primary Examiner*—Lynne H. Browne
*Assistant Examiner*—Doug Hutton
(74) *Attorney, Agent, or Firm*—Daniel Kramer

(57) ABSTRACT

A device for removably holding and pressing a holder or carrier, supporting a graphics or textual display, against the interior of a raisable auto window by means of a leaf spring hooked over the top edge of the window and configured to exert force against the carrier when raised.

17 Claims, 4 Drawing Sheets

AUTO WINDOW GRAPHICS HOLDER

BACKGROUND

1. Field of the Invention

This invention is directed to means for temporarily securing a textual and graphic display against the interior of an auto window that has a "raise/lower" capability, whereby such a display is easily readable from the auto exterior. It is further directed toward means for securely positioning such a display on the inside of such window. It is further directed to carrier means for holding such display and most particularly for spring means for engaging the top of such auto window while the window is partially lowered and for pressing the carrier means securely and substantially flush against the interior of the auto window when the window is fully raised.

BACKGROUND

2. Prior Art

Textual and graphic displays are most commonly secured against the interior of driver-side windows by adhesive applied to all or part of the periphery of the display. Another method employs adhesive tape that is positioned to engage the display around its periphery by half the tape width and the window interior by the other half of the tape width. A third method requires the insertion of the display in a clear plastic envelope held in place on the window interior by suction cups. A variation of the third method hangs the plastic envelope from the rear view mirror, thereby allowing the graphics sheet to be observed through the windshield. A variation of this method employs a textual displays printed on heavier tag-weight material adapted to be hung directly from the rear-view mirror or sun shade visor. A fourth method uses a thin specially coated plastic sheet called "static cling" that is substantially larger in each dimension than the display. The display is held against the window interior and the static cling material is applied over the display, holding the display to the window interior by the propensity of the static cling to adhere to the glass where the cling contacts the glass directly around the edges of the display. Such "Buyers' Guides" or "Odometer Disclosure Statements" and several of the above described types of holder devices are available from MBR Marketing, 1-800-443-4333 as Catalog numbers BG-24, BG-2, HG-100 and BGP.

BACKGROUND

3. Discussion of Prior Art

While the above described first method securely holds the edges of the display material against the window interior, the center portion of the display material tends to bend away from the window, thereby rendering the textual material difficult to read. Further, when such tape-secured graphics must be removed to allow a prospective purchaser to test drive the auto, the displayed material is almost never properly resecured and eventually is damaged or destroyed, thereby making it necessary for the seller to recreate the material at additional cost, should the auto not be sold to that prospective purchaser.

Further, when the material so adhesive secured has remained in place for en extended period and subjected to the sun's rays, the adhesive tends to polymerize, thereby making its removal extremely difficult and requiring time-consuming action by the seller with solvent or scraper or both to remove the tape residue to the satisfaction of the purchaser. Further, when the adhesive has been applied over a tinted overlay or after-market tinting, the chance of damage to the tinted layer is especially high. Further, textual material is frequently not readable though factory or after-market tinted glass, and unreadability of this material may constitute a violation of state or federal laws.

Displays are sometimes simply left text-upwards on the dashboard of the auto but the text is difficult to read and such position may not satisfy some legal requirements.

Textual material hung from the rear-view mirror and intended to be read through the windshield are very difficult to read, especially since the material is not held directly against the glass of the windshield.

Static Cling material does not retain its dinginess for more than a few uses. Further, once removed, some skill is required to replace it properly. Further, detailers or others who clean cars frequently apply wax or silicone coatings to the windows. Neither Static Cling nor adhesives stick reliably to these contaminated surfaces.

BACKGROUND

All used cars sold in the USA by automobile deals must, by law, have a "Buyers' Guide" or "Odometer Disclosure Statements". These are printed forms found on all used cars for sale at auto dealerships. These forms must generally be approved by the Federal Trade Commission (FTC). They must be placed in a conspicuous location on the car for easy viewing by a prospective purchaser. These forms typically measure 7⅜ inches wide by 11 inches high. The form must indicate the automobile make, model, VIN number and other descriptive information such as whether or not there is a warranty and if so, the nature of the warranty. The name for this form in the industry is "sticker."

In recent years auto dealers have been offered by vendors a so-called "Customized Buyers' Guide." or sticker. This custom sticker is a computer printout in an attractive format designed to resemble a New Car Buyers' Guide. This Buyers' Guide has clearly imprinted on one half its face all the FTC required information plus, on the other half, one or more sales blurbs plus a listing of most of the options with which the car is equipped. Since most new car buyers do not retain the original sticker listing these options which came with their new car, the information must be searched out by the sticker vendor when the original car owner sells his car to a dealer years later. These vendor functions save the dealer much time and he pays the vendor for preparing each custom sticker. The custom buyers' guide is approximately 14½ inches wide by 11 inches high. Dealers have found the custom "sticker" to provide the required information in an attractive format and have almost universally adopted it.

Typically a dealer places a hand written required FTC form on each "new" used car when it is placed on his lot for sale. The vendor of the custom sticker regularly visits each dealer, removes the handwritten FTC form, types out the required FTC information on one side of the sticker and the relevant merchandising information on the other.

The sticker is substantially always attached to the inside surface of a driver's side window by a pressure sensitive adhesive or tape positioned on the perimeter of the sticker. In hot weather the adhesive softens and the sticker often drops off onto the car floor. Sometimes dealers' efforts to clean a used car result in wax that has been deposited on the window interiors. Such wax provides a poor base for adhesive, preventing reliable attachment of the sticker.

Further, the adhesive method of attachment is badly flawed and costs the auto dealer frustration, time, and costs of replacement stickers as described above. A prospective purchaser must remove the sticker before test driving the auto or s/he will be in violation of the law that requires windows to be unobstructed. She cannot lower the window without the high possibility of damaging the sticker or, worse, getting it stuck in the window elevator mechanism, thereby imposing substantial repair cost on the dealer.

Removing the sticker almost always results in its destruction. Further, even if the sticker is not destroyed on removal, it cannot be successfully glued back neatly and intact on the inside surface of the window. Therefore, after a single demonstration ride the sticker may wind up wrinkled, torn and laying on the car seat or the floor or simply destroyed or lost.

Sometimes a cautious prospective buyer requests a copy of the sticker, imposing on the dealer the requirement for spending time to remove it undamaged. Finally, the sticker with integral pressure sensitive adhesive costs more than a plain paper "sticker."

The present invention totally and simply solves the problem of instantly attaching and removing both the Buyers' Guide and the Customized Sticker flush to any lowerable side auto window, such as the driver's side window, and does so with reusable apparatus that is simple to fabricate and low in initial cost and does not employ any adhesive.

SUMMARY OF THE INVENTION

Means for holding a paper display securely against an auto window, the display having a length dimension and a height dimension, the window having an interior side, an exterior side, an upper edge and a lowered and a raised condition, and further providing a channel into which the upper edge of the window enters when in its raised position, said means comprising:

a plastic carrier having a length dimension and a height dimension substantially the same as or larger than the dimensions of the paper display, means attached to the carrier for grasping the paper display and holding an edge of the paper against the carrier, said carrier being positioned against the window whereby the paper display is positioned between the carrier and the window, leaf spring means for engaging the upper edge of the window and for providing tension against the carrier when the window is in its raised position with the upper edge of the window positioned within the channel, thereby holding the carrier against the window interior side whereby the display is held securely against the window interior between the carrier and the window interior.

OBJECTS AND ADVANTAGES

It is an object of the present invention to provide means for holding a textual or graphics paper display securely against the interior of an auto window without the use of any adhesive.

It is a further object to provide such means comprising a substantially flat carrier sheet for holding the display together with spring means for engaging the top edge of the window and for applying force against the carrier for holding it against the window interior.

It is a further object to provide such spring means in the form of a leaf spring having a hook at one end for engaging the window edge when lowered and a shape which is substantially relaxed when the window is in its lowered position and its upper edge is not positioned within the channel, further providing that the spring shape is substantially stressed when the window is in its raised position, thereby forcing the hook end of the spring into the window channel, thereby applying force to the carrier and to the paper display whereby the display is held securely against the window interior.

DETAILED DESCRIPTION OF THE INVENTION

Figure 1:
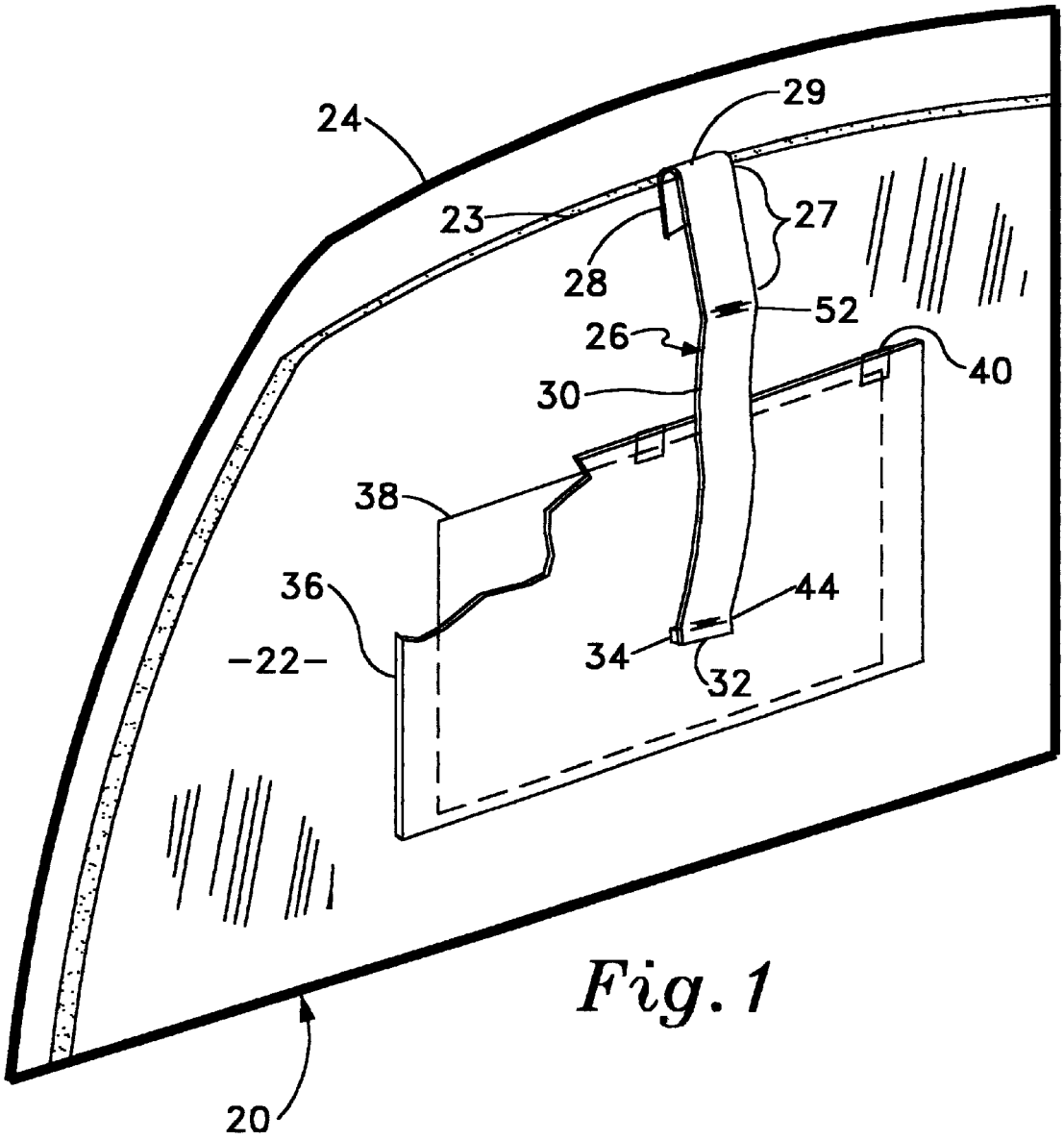
FIG. 1 shows an auto window slightly lowered with the plastic carrier broken away to show the paper graphic sheet sandwiched between it at the window and the stressed leaf spring hooked over the top window edge.

FIG. 1 illustrates the application of the invention to the assembly 20 of a partially lowered auto window 22 in its channel 24. Graphics display 38 is shown sandwiched between auto window 22 and carrier 36. Carrier 36 is formed of a thin flexible plastic sheet of the material known as PETG. This material has been selected for its properties of transparency, flexibility, impact strength, and light weight. Other materials with similar properties would be suitable. Carrier 36 has a typical thickness of 0.040 inches and typical length of 15 inches and height of 11½ inches. The dimensions of the carrier 36 are not primary characteristics of the invention and other materials, thicknesses and overall dimensions may be selected to meet the requirements of the graphics sheet 36 to be displayed, and the auto window. Across the top of carrier 36 are positioned substantially equally spaced clips 40 provided for the purpose of initially holding graphics sheet 38 in position on carrier 36. The preferred shape of clip 40 may be observed better by reference to FIG. 10A. The clip is a commercially available device model 847-CL secured from the Outwater Corporation at http://www.outwater.com.

Leaf spring 26 is formed with U-bend 29 at one end, thereby providing a shorter straight portion 28 and a longer substantially straight portion 27 adjacent the U-bend 29. The U-bend 29 is positioned snugly over the upper edge 23 of window 22.

The substantially straight portion 27 of leaf spring 26 terminates at its end distal to the U-bend 29 in a kink 52, a bend of relatively small radius, which provides the transition to curved portion 30 terminating at spring end 32. A line, tangent to the end of curved part 30 that is adjacent straight part 27, forms an angle with the straight portion 27 between 18 and 25 degrees. Spring end 32 has a slight reverse curvature 44 (shown more clearly in FIGS. 3, 4 and 5) provided for the purpose of increasing the spring area in contact with carrier 36, thereby providing greater friction between the spring end 44 and carrier 36. A friction pad 34 composed of soft rubber or plastic is optionally provided to improve resistance to carrier slippage.

Figure 2:
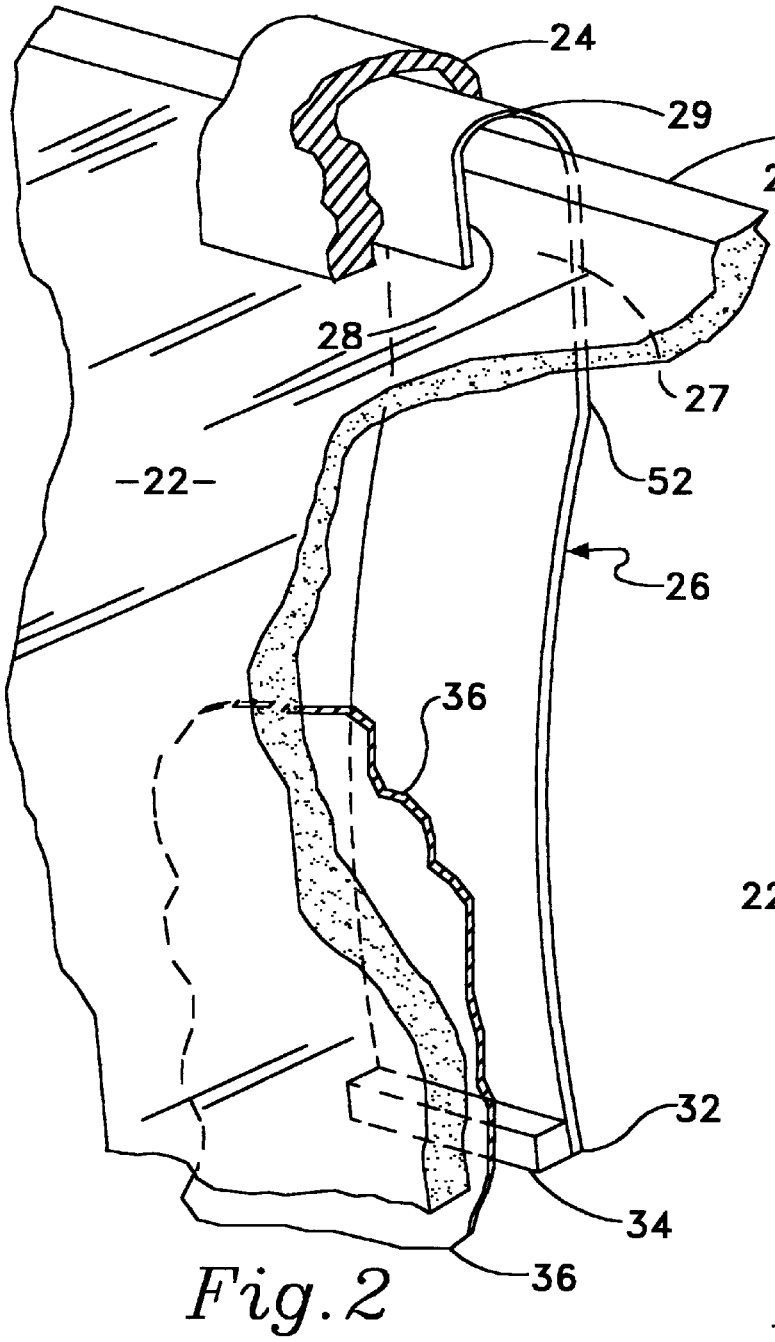
FIG. 2 is an isometric projection showing in broken away views the auto window, the stressed leaf spring of the invention hooked over the top edge of the raised window while pressed into the upper window channel and the carrier for the graphic sheet positioned between the cushioned end of the stressed leaf spring and the window.

Referring now to FIG. 2, window 22 is shown substantially fully raised and seated within channel 24. Channel 24 typically is formed of a soft material such as felt to allow the window 22 to be properly raised and seated while allowing for minor variations in the shape and thickness both of channel 24 and window 22. Stressed spring 26 is shown with its U-bend 29 positioned over the top edge 23 of window 22. U-bend 29 has been forced upwards fully into and seated into channel 24 by the upper edge 23 of window 22, thereby squeezing the straight portions 27, 28. This forceful seating process provides substantially rigid support and alignment for the substantially parallel straight portions 27 and 28 adjacent to U-bend 29 of the leaf spring 26. A portion of carrier 36 is shown sandwiched between the soft pad 34 fastened to the end 32 of spring 26 and window 22.

Figure 3:
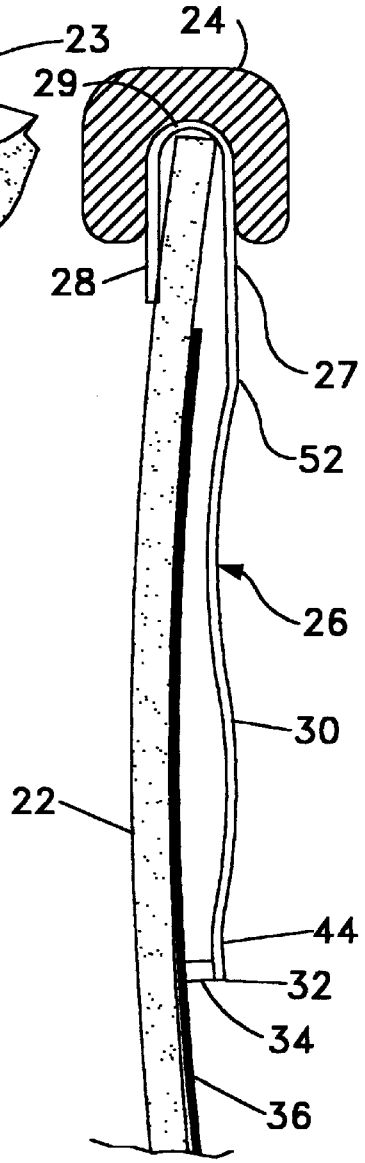
FIG. 3 illustrates the relative placements of the raised auto window, the window channel, the stressed leaf spring and the carrier.

In FIG. 3 there are shown the major elements of the invention in orthogonal cross-section. Window 22 is shown in raised position within felt-like channel 24. The top edge 23 of the window 22 has forced U-bend 29 securely into channel 24, thereby forcing the longer portion 30 of leaf spring 26 to assume a bent, highly stressed position 30, thereby applying significant force to carrier 36 through friction pad 34. While friction pad 34 is positioned at the end 32 of spring 26, the pad may be omitted where the force of spring 26 is sufficient to hold carrier 36 in place.

It should be noted that the relatively sharp bend or kink 52 immediately adjacent the straight portion 27 of spring 26 is of the essence in providing the proper stressed shape to springy portion 30 of spring 26. Note also that straight portions 26 and 27 that adjoin U-bend 29 are also important to the spring function because they provide the anchor for the springiness of the longer springy portion 30 of spring 26 the end 32 of which bears directly or indirectly on carrier 36.

Figures 4, 5, 6, 7, 8, 9:
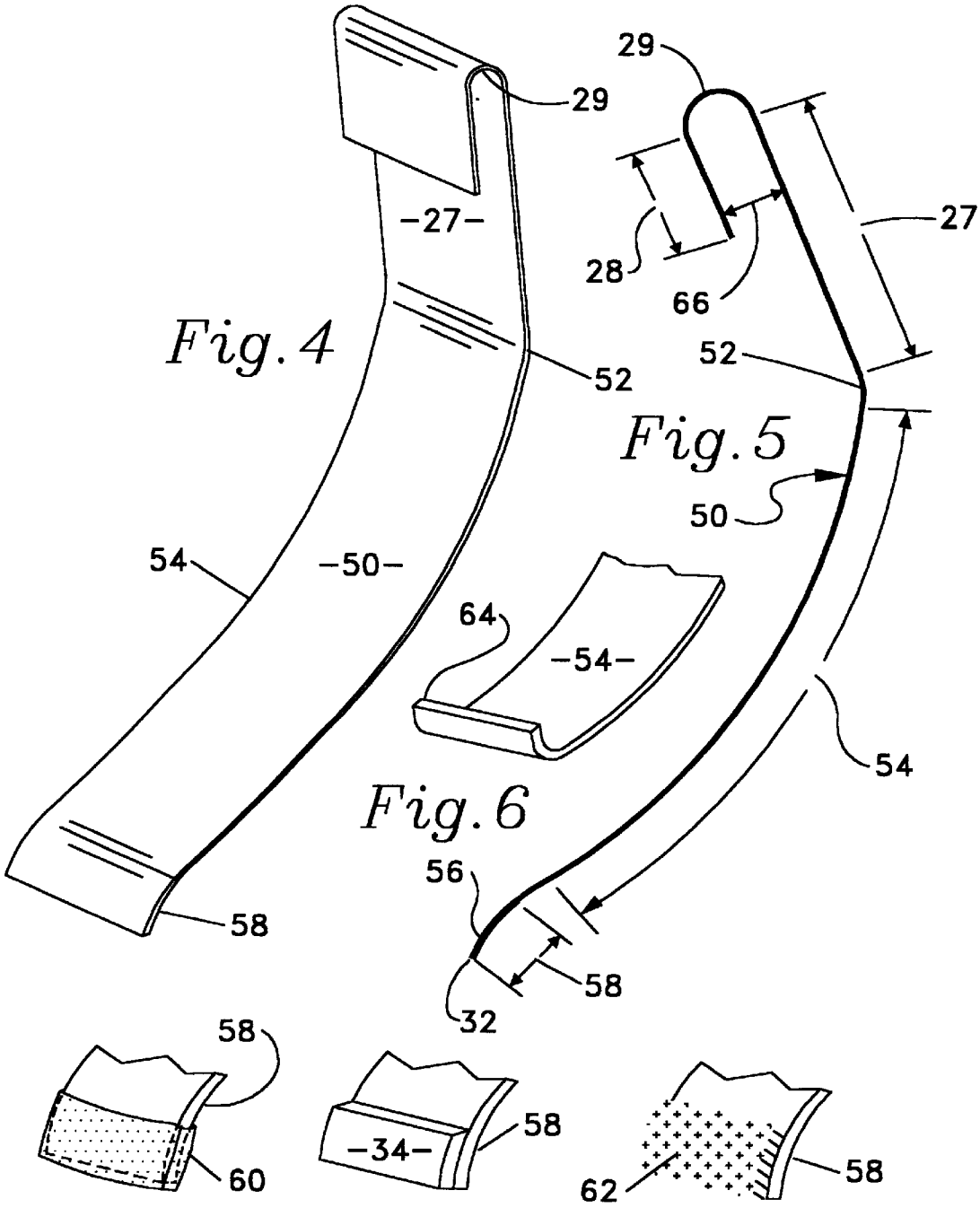
FIGS. 4 and 5 illustrate the preferred shape of the unstressed leaf spring.
FIGS. 6,7,8 and 9 show modifications of the end of the leaf spring for securing the carrier in position.

FIGS. 4 and 5 show a preferred shape of leaf spring 50 while it is unstressed. The same spring is referred to as element 26 in earlier figures where it is shown having a different contour under stressed conditions. Spring 50 is formed of mild cold rolled annealed steel spring 0.032 inches thick, 1 inch wide and 10 inches long before being fabricated into its finished unstressed shape. The spring is hardened by heating, carburizing and quenching by processes which are well known to metallurgists and heat treaters, thereby providing the required springiness. Alternately a hardenable alloy requiring a slower or oil quench can be substituted. The heat treating process optionally can produce a black oxide film over the entire body of the spring which provides a measure of rust resistance. Within the limits described, the spring may be formed of other materials, ferrous or non-ferrous or non-metallic, and may have other widths and lengths.

Referring now to FIG. 5, the U-bend 29 is formed so that dimension 66, the distance between the short leg 28 and the long substantially straight leg 27 is about ¼ inch. This opening accommodates substantially all standard window glasses. Somewhat greater distances for dimension 66 are tolerable, keeping in mind that a sufficient length of the portions 28, 27 must be seated within the interior of channel 24 to stabilize and force kink 52 into a stress producing position closer to window 22.

Typically shorter straight leg 28 has a length 28 between one half inch and about 1 inch. The longer, substantially straight, leg 27 has a length between 1¾ and 2½ inches. The length of the curved flex portion 54, upon which the spring depends for the stress or tension required to hold carrier 36 in position, is typically about 6 inches. That length is the difference between 10 inches, the initial flat length of the spring and the other dimensions. Reverse bend 56, 58, terminating in the end 32 of spring 50, has a length of about (0.5) inch. The angle of the bend between the straight leg 27 and a tangent to the adjacent curved portion 54 is typically between 19 and 23 degrees though angles as small as 15 degress and as great as 25 degrees may be required in certain circumstances. The greater the angle, the more stress is applied to the carrier.

FIG. 7 shows a friction enhancing coating, typically of a rubberized material, which is applied by dipping the end portion 58 of spring 50 into the latex or similar material. This coating 60 enhances friction between the spring end and the carrier.

FIG. 8 shows in somewhat greater detail the friction enhancing pad 34 (shown also in FIGS. 1, 2 and 3). Pad 34 is generally secured with an integral pressure sensitive adhesive coating, though other means of attachment may be employed.

Figure 12:
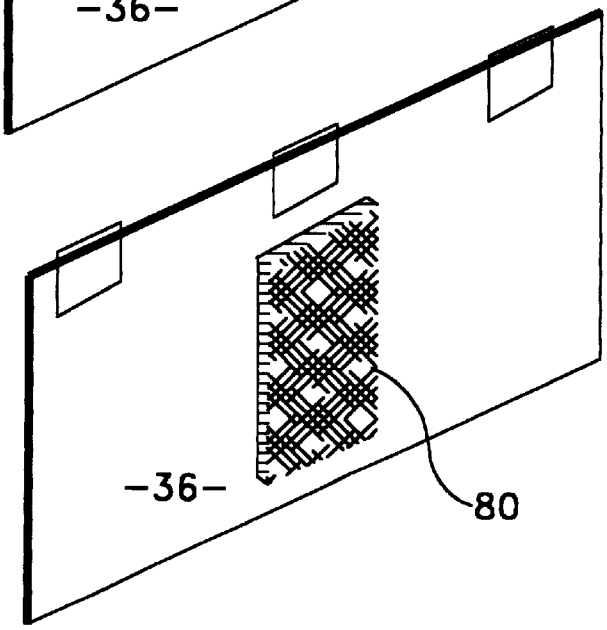
FIG. 12 shows a carrier construction with a hook/loop overlay, provided to cooperate with the leaf spring construction of FIG. 9.

FIG. 9 shows one portion of a hook-loop assembly applied as a fabric strip 62 to the convex part of the spring end. This hook/loop strip is intended to coact and provide secure but variable positioning of carrier 36 by engaging and securing to its loop/hook mate 80 shown in FIG. 12.

In FIG. 6 the end of spring 50 is formed into upturned lip or edge 64. This edge 64 is turned upward in the same direction as straight leg 28. The upturned edge 64 is intended to engage one of slots 76, which have a straight bottom edge and curved upper edge. Alternatively upturned edge 64 may engage one of slots 78 which have similarly curved upper and lower edges.

Figure 10:
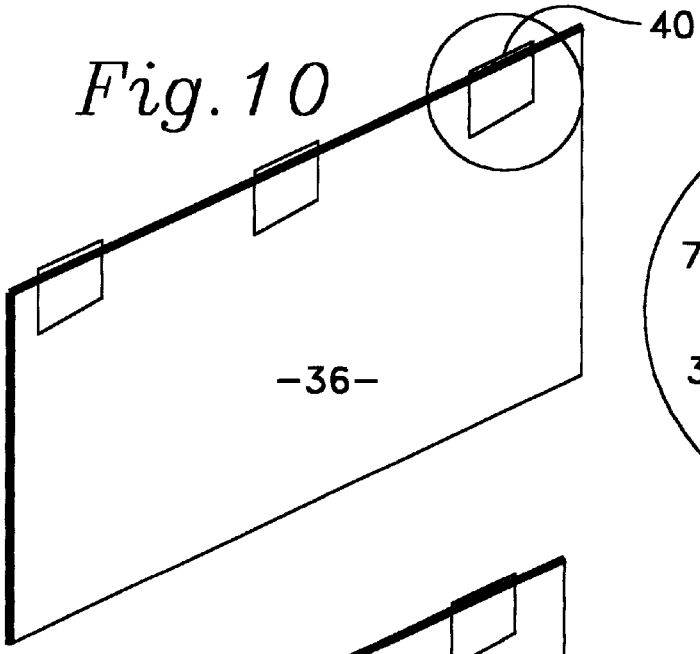
FIGS. 10 and 10A show the carrier and a detail of the clip employed to hold the paper graphics sheet in position.
Figure 10A:
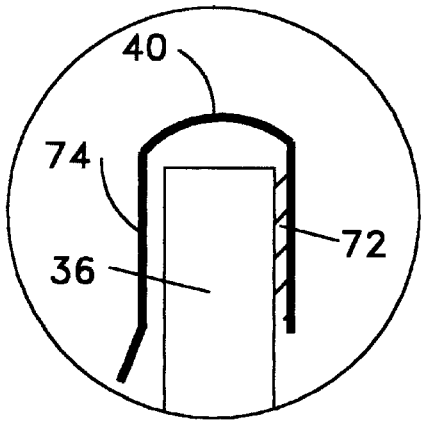
Figure 11:
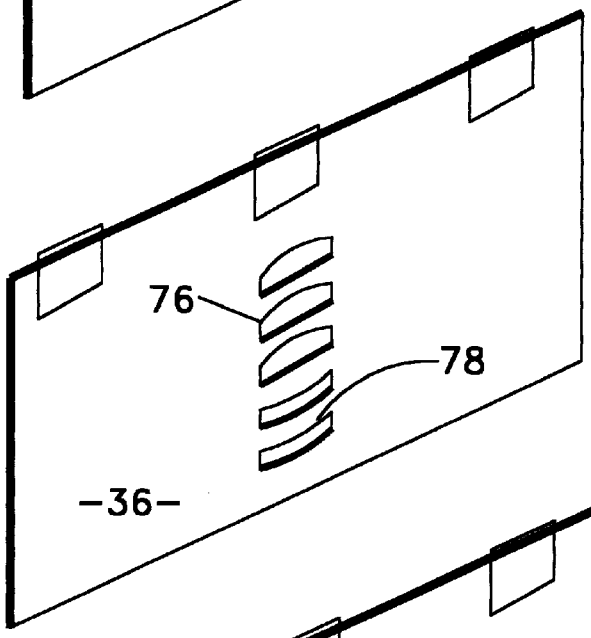
FIG. 11 shows the carrier with cavities or perforations intended to cooperate with the leaf spring construction of FIG. 6.

In FIG. 10 there is shown carrier 36 in which the relative positions of clips 40 are displayed. FIG. 10A is an end view of carrier 36 showing clip 40 secured to carrier 36 by adhesive 72. The paper bearing the text or graphics is secured between leg 74 of clip 40 and carrier 36.

In an optional construction, no carrier is employed and element 36 is the graphic or textual material to be displayed and the spring 26 bears directly on it. In this alternate construction the material 36 is formed or is printed on a heavier more resilient material than ordinary 20 pound paper. In still another embodiment of the invention the graphic material to be displayed is printed directly on the carrier 36.

From the foregoing description, it can be seen that the present invention comprises a simple device for positively but removably securing a textual or graphics display to the inside of an auto window that can be raised and lowered. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims, its elements and equivalents thereof. In all uses within this specification and claims the terms graphics display and textual display are synonymous and interchangeable.

I claim:

1. Means for holding a paper display securely against an auto window, the display having a length dimension and a height dimension, the window having an interior side, an exterior side, an upper edge and a lowered and a raised condition, and further providing a channel into which the upper edge of the window enters when in its raised position, said means comprising:

planar carrier means for engaging and securing the paper display; said carrier means being positioned against the window whereby the paper display is positioned between the carrier means and the window, leaf spring means for engaging the upper edge of the window and for providing force against the carrier means when the window is in its raised position with the upper edge of the window positioned within the channel, thereby holding the carrier against the window interior side whereby the display is held securely against the window interior between the carrier and the window interior.

2. Means for holding a paper display as recited in claim 1, further providing a means attached to the carrier means for grasping the paper display and holding an edge of the paper against the carrier.

3. Means for holding a paper display as recited in claim 1, further providing the leaf spring includes a hook shaped window engaging part.

4. Means for holding a paper display as recited in claim 3 further providing the hook shaped part of the spring includes:

a first substantially straight leg having a first end and a second end, the length of the first leg being greater than 0.5 inch (12.7 mm), the first leg being intended to be positioned on the exterior side of the window and a second straight leg intended to be positioned on the interior side of the window, substantially parallel to the first leg, the second leg having a first end and a second end and having a length between 1¾ and 2½ inches (44.5 and 63.5 mm), the first end of the second leg being connected by an arcuate spring portion to the first end of the first leg.

5. Means for holding a paper display as recited in claim 4, further providing an arc-shaped part of the leaf spring having a length of about 6 inches and having a first end and a second end, the first end of the arc-shaped part being joined to the second end of the second leg.

6. Means for holding a paper display as recited in claim 5, further providing that a line drawn tangent to the first end of the arc shaped part forms an angle with the second leg between 15 and 25 degrees.

7. Means for holding a paper display as recited in claim 6 further providing that the second end of the arc shaped part is provided with a reverse bend having a length between 0.5 and 0.75 inches.

8. Means for holding a paper display as recited in claim 5 further providing means positioned at the second end of the arc shaped part for securely holding the carrier.

9. Means for holding a paper display as recited in claim 8 where the holding means is selected from the group consisting of: rubberized coating, frictions enhancing pad and a hook/loop portion.

10. Means for holding a paper display as recited in claim 8, where the holding means comprises an upturned lip formed in the second end of the arc-shaped part, the lip being turned in a direction to engage the carrier.

11. Means for holding a paper display as recited in claim 10 further providing means formed in the carrier to engage the lip.

12. Means for holding a paper display as recited in claim 11 further providing that the lip engaging means comprises a slot having a shape selected from the group comprising an arcuate edge opposite a straight edge and an arcuate edge opposite an arcuate edge.

13. Means for holding a graphic display securely against an auto window, the display having a length dimension and a height dimension, the window having an interior side, an exterior side, an upper edge and a lowered and a raised condition, and further providing a channel into which the upper edge of the window enters when in its raised position, said means comprising:

leaf spring means for engaging the upper edge of the window and for providing force against the display when the window is in its raised position with the upper edge of the window positioned within the channel, thereby holding the display against the window interior side.

14. Means for holding a display as recited in claim 13, further providing the leaf spring means includes a hook shaped window-engaging part.

15. Means for holding a display as recited in claim 14, further providing the hook shaped window-engaging part of the leaf spring means includes:

a first substantially straight leg having a first end and a second end, the length of the first leg being greater than 0.5 inch (12.7 mm), the first leg being intended to be positioned on the exterior side of the window, and a second straight leg intended to be positioned on the interior side of the window, substantially parallel to the first leg, the second leg having a first end and a second end and having a length between 1¾ and 2½ inches (44.5 and 63.5 mm), the first end of the second leg being connected by an arcuate spring portion to the first end of the first leg.

16. Means for holding a paper display as recited in claim 15, further providing an arc-shaped spring portion having a length of about 6 inches and having a first end and a second end, the first end of the arc-shaped spring portion being joined to the second end of the second leg.

17. Means for holding a paper display as recited in claim 16, further providing that a line drawn tangent to the first end of the arc-shaped spring portion forms an angle with the second leg between 15 and 25 degrees.

* * * * *